United States Patent [19]

O'Driscoll

[11] Patent Number: 4,686,802

[45] Date of Patent: Aug. 18, 1987

[54] STRUCTURAL MEMBER

[75] Inventor: Bryan E. O'Driscoll, Mayne, Australia

[73] Assignee: Nu-Steel Engineering Pty. Ltd., Mayne, Australia

[21] Appl. No.: 862,106

[22] Filed: May 12, 1986

[51] Int. Cl.[4] ..... E04B 7/00; E04B 7/12

[52] U.S. Cl. ..... 52/94; 52/82; 52/92

[58] Field of Search ..... 52/92, 94, 82

[56] References Cited

U.S. PATENT DOCUMENTS

| | | | |
|---|---|---|---|
| 1,988,388 | 1/1935 | Miotan | 52/92 |
| 4,455,792 | 6/1984 | Pasco | 52/90 |

FOREIGN PATENT DOCUMENTS

| | | | |
|---|---|---|---|
| 79530 | 9/1950 | Czechoslovakia | 52/90 |
| 2646533 | 4/1978 | Fed. Rep. of Germany | 52/90 |
| 566152 | 12/1944 | United Kingdom | 52/90 |
| 676852 | 8/1952 | United Kingdom | 52/92 |

*Primary Examiner*—Alfred C. Perham

*Attorney, Agent, or Firm*—Lackenbach Siegel Marzullo & Aronson

[57] ABSTRACT

A support structure for forming eave corners on a hipped roof of a steel framed structure comprises a rectangular frame having two triangular sub frames tiltable along their adjacent diagonal sides. The inner corner of the rectangular sub frame is supported above the outer diagonal corner to form triangular planes coplanar with adjacent roof planes on each side of a hip line, the rectangular frame being cantilevered over the corner walls of the building to form an eave corner. The support structure may also be used to form internal or external corners on a verandah roof. A method for constructing hipped roofs on steel frame buildings is also provided.

8 Claims, 9 Drawing Figures

STRUCTURAL MEMBER

This invention is concerned with a structural member for use in building construction, a structure employing such members and an improved method of construction.

The invention is suitable for steel frame constructions, particularly those employing a hip roof and/or a verandah.

As the costs of timber and skilled labor (especially carpenters) continues to rise, considerable interest is being shown in the use of pre-fabricated steel frames in the construction of buildings such as domestic dwellings and the like. Many advantages arise from the use of steel frames over traditional timber framed structures in that generally they are easier to assemble in a factory, they are much lighter to handle and transport and the finished construction is substantially stronger. Various cyclone ratings are readily engineered into steel framed structures with only minimal additional costs.

Possibly the most advantageous feature of steel framed structure is that the various components such as wall frames, roof trusses etc. may be designed to permit rapid erection utilizing unskilled labor. In this regard the various frame components may incorporate predrilled holes, brackets and the like whereby the structure may be simply bolted together to achieve a very strong rigid construction.

Steel framed structures are, for all of their advantages, not without certain disadvantages. For example a high degree of precision must be maintained during prefabrication to ensure accurate alignment of bolt holes during assembly. It is generally not possible for an unskilled laborer to make relatively minor adjustments during assembly of a steel framed structure to cure misalignments etc. in the same manner that a carpenter would readily cure such defects in construction of a timber framed structure. Any cost advantage in the use of prefabricated steel frames can be readily eroded if adjustments requiring in-situ cutting and welding by highly skilled persons are found to be necessary.

Accordingly, in order to avoid such on-site difficulties, steel framed structures have hitherto been limited to relatively simple designs such as houses having a rectangular plan and a pitched roof with gable ends.

A method of construction of a steel framed structure having a hipped roof is known but such a structure is not entirely satisfactory in that it invariably requires difficult on-site adjustment by skilled operators.

In the prior art hip roof structure, a specially fabricated hip rafter construction is required. The hip rafter is comprised of a pair of C-section channel members welded back to back with triangular gussets between the adjacent faces to form a "V" shaped channel between those faces. For differing roof slopes differing angles are required for the triangular gussets. For example for a roof pitch of 18 degrees the gusset angle required is 26 degrees. Similarly for roof pitches of 20 degrees and 22 degrees, the respective gusset angles are 29 degrees and 32 degrees.

In addition shaped slots must be cut from the downwardly and outwardly directed opposed bottom flanges of the C-shaped channels comprising the hip rafter in order to permit correct load bearing contact between the hip rafter and the truncated trusses in the hip roof region. These slots are difficult to prefabricate with accuracy and often require in-situ trimming to enable the hip rafter to seat correctly on the roof trusses. At the upper end of the hip rafter angled cuts or a special bracket are required to connect the end of the hip rafter to the peak of the gabled roof.

At the lower or outward end of the hip rafter a pair of jack rafters are welded at 45 degrees to the hip rafter to form an included angle of 90 degrees between the jack rafters and these assist in supporting the fascia. The outermost end of the hip rafter must be trimmed on each angled face at 45 degrees to provide a 90 degree corner to receive the ends of the abutting fascias.

On the underside of the hip rafter a right angle bracket is welded to permit attachment to the adjacent top plates of wall frames at the corner of the structure. This bracket must be mounted at an angle appropriate to suit the pitch of the hip rafter.

It can be seen clearly that although the use of such a hip rafter construction will permit hip roof construction on a steel frame structure, much of the cost advantage of a steel frame structure is lost through the disadvantages inherent in the hip rafter system described above.

Accordingly it is an aim of the present invention to overcome or alleviate the problems of prior art hip roof construction systems in steel frame structures.

According to one aspect of the invention there may be provided a support assembly for a corner of a roofing structure, said support assembly comprising:

a rectangular frame having a pair of substantially triangular planar sub frames, each said sub frame being in the form of a right isosceles triangle, the hypotenuse side of each triangular sub frame abutting to form a diagonal intersection across said rectangular frame, said hypotenuse of each triangular sub frame combining in use to form a hip rafter and an adjacent side of each triangular sub frame forming a rafter element disposed at 90 degrees relative to each other; and, mounting means associated with one end of said hip rafter element to support said one end above an opposed end of said hip rafter whereby said planar triangular sub frames are tilted relative to each other along said diagonal intersection to co-operate with adjacent planes of a roof structure, said triangular sub frames each including a connecting member between and adjacent divergent ends of said hypotenuse side and said adjacent side.

The rafter elements and rafter members may be comprised of the same cross section or a different cross section. Preferably the elements and members each comprise a substantially identical C-shaped channel section. If required the support member may include further members connected between the free ends of the hip rafter members and the rafter elements to define a pair of triangular frames having adjacent bases formed by the hip rafter members.

Further attachment brackets may be disposed between adjacent hip rafter members and rafter elements for attachment to a building frame.

In order that the invention may be more readily understood, preferred embodiments of the invention will now be described with reference to the accompanying drawings in which.

Figure 4A:
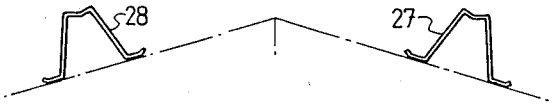
FIG. 4 shows the mounting of hip battens to the hip roof structure.
Figure 4:
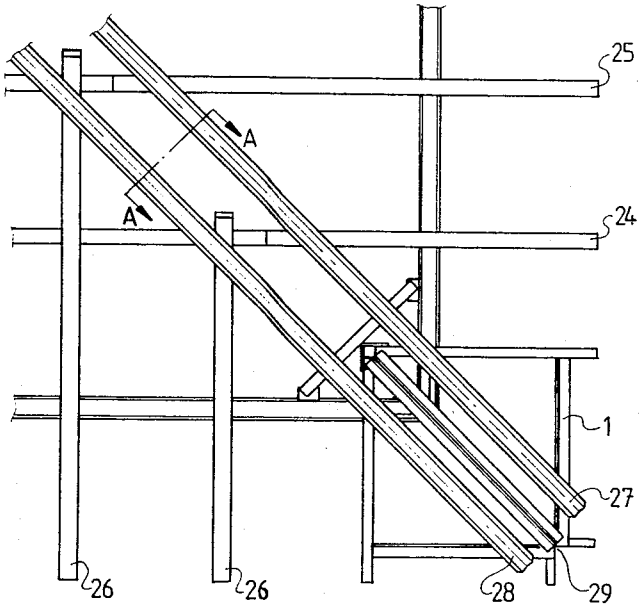
Figure 5:
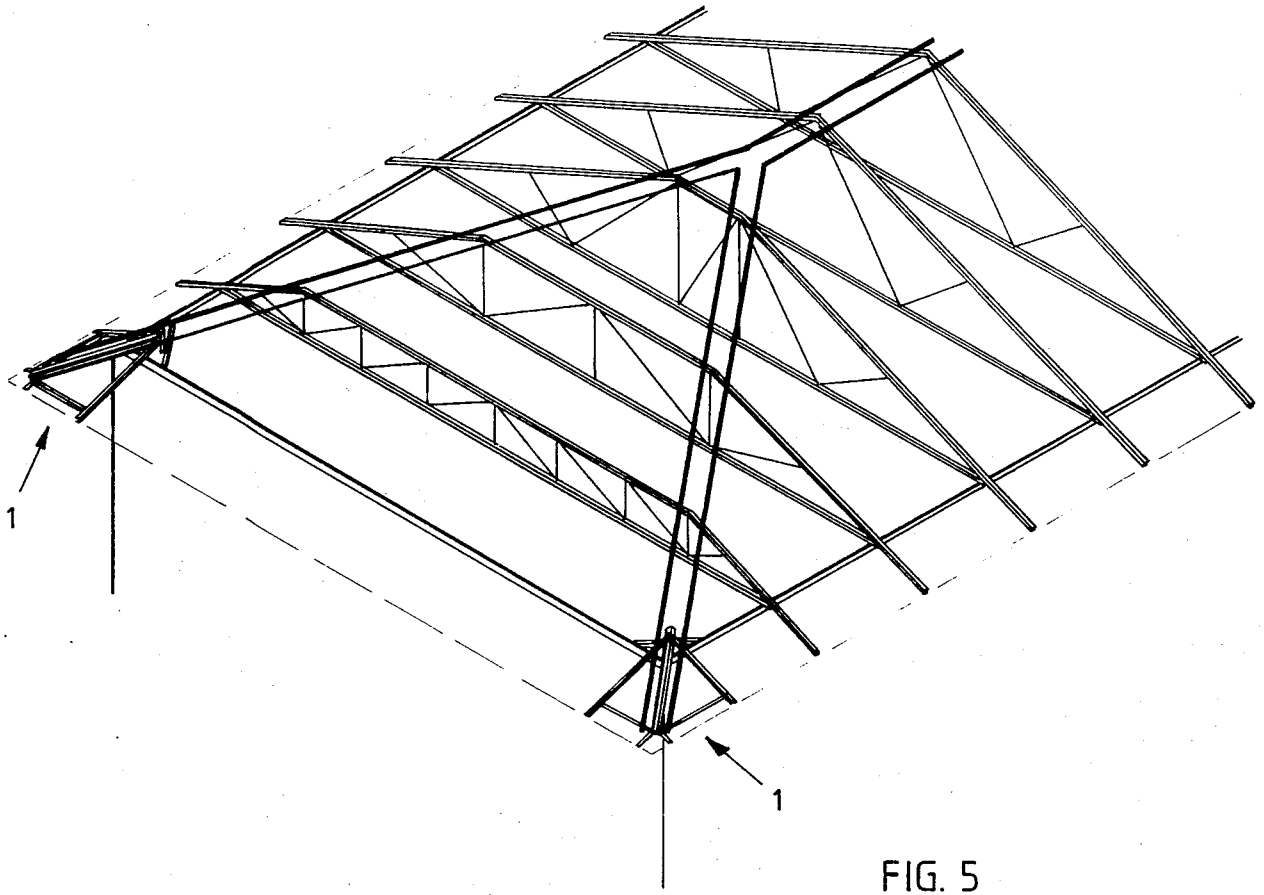
Figure 6:
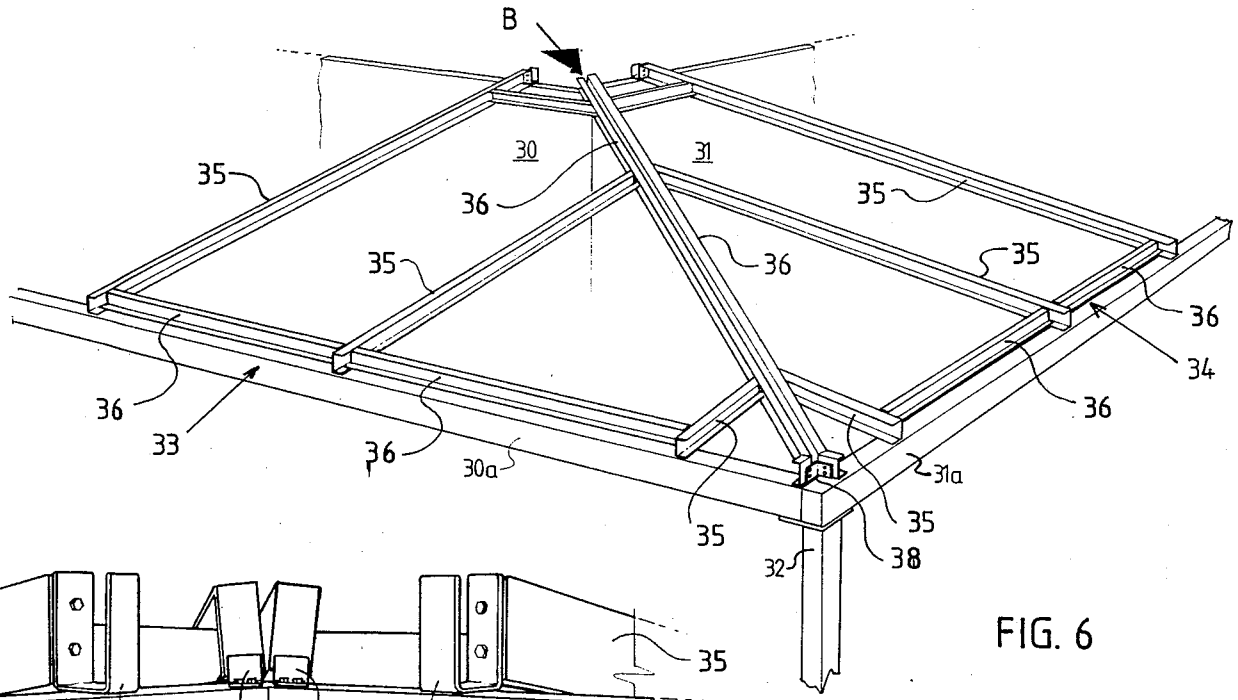
Figure 7:
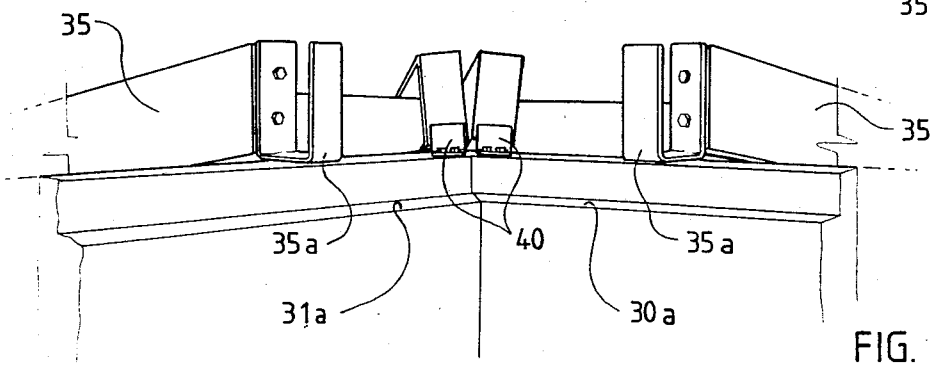
Figure 8:
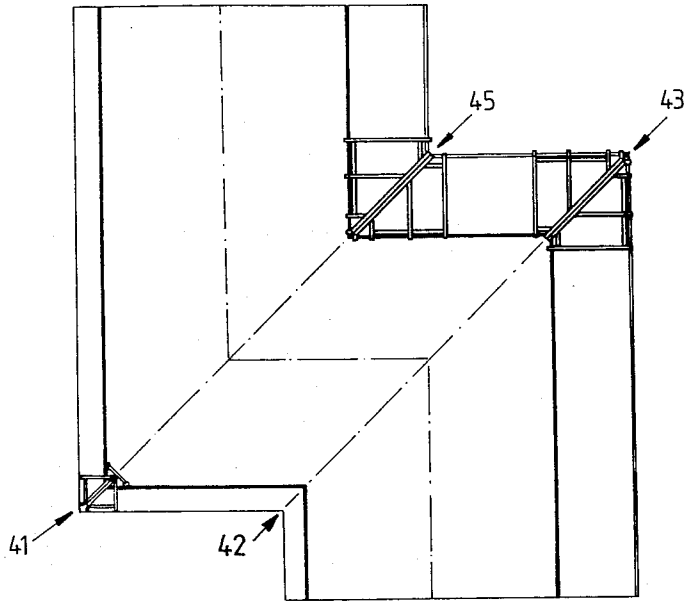

FIG. 4*a* is a sectional view taken along the line marked A—A in FIG. 4;

FIG. 5 shows schematically a substantially completed hip roof structure;

FIG. 6 shows an alternative form of support member in use as a verandah corner support;

FIG. 7 shows a fragmentary detailed view looking in the direction of arrow B shown at the inside corner of the mounting for the support member of FIG. 6; and FIG. 8 shows a complex hip roof structure.

Figure 1:
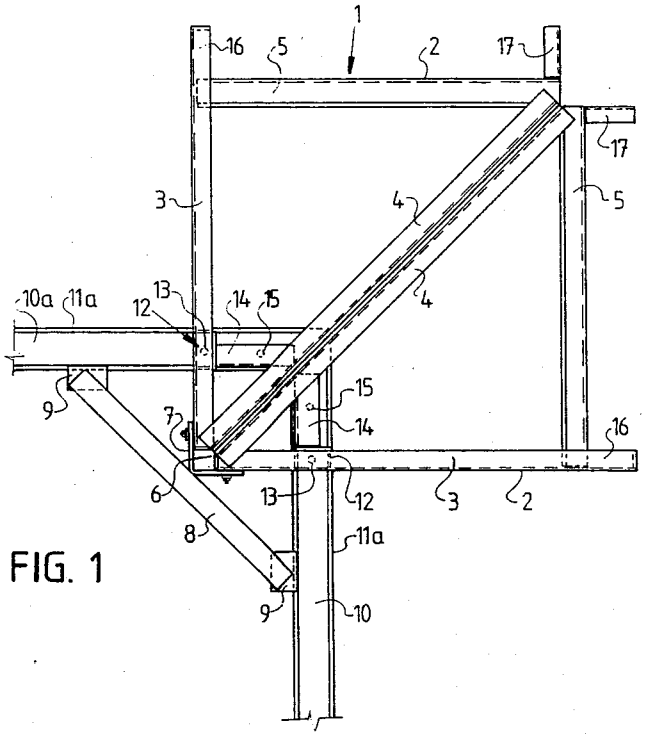
FIG. 1 shows a support member for the corner of a hip roof structure.

In FIG. 1 the support bracket 1 comprises a pair of triangular frames 2 each comprising a rafter element 3 known as a "jack" rafter, a hip rafter member 4 and a connecting intermediate member 5. Each member is comprised of a 104×40×1.6 mm galvanized steel channel section with square cut ends. The members are welded at their junctions to provide a rigid triangular frame, the channels facing inwardly.

At the normally inner corner 6 the frames 2,2*a* are bolted to an upright length of angle section steel bracket 7 near its upper end while the lower end of bracket 7 is welded to cross brace 8. Brace 8 includes brackets 9 at each end for attachment to the upper plates 10,10*a* of external wall frames, 11,11*a* respectively.

Mounted within the channelled aperture of jack rafters 3 are U-shaped brackets 12 having upright legs welded to the inner channel face and the connecting legs of the bracket protruding to rest on top plates 10,10*a*. Bolt holes 13 are provided in the connecting legs to enable bolting to the top plates 10,10*a*. Further brackets 14 may be provided between hip rafters 4 and brackets 12 to provide a secure mounting through additional bolt holes 15.

The outer ends 16 of jack rafters 3 extend beyond the face of connecting members 5 and brackets 17 extend a similar distance from the adjacent ends of members 5. Brackets 17 and extended portions 16 align with rafters extending from each face of the roof to receive a fascia (not shown) which is attached thereto by clips (not shown).

Figure 2:
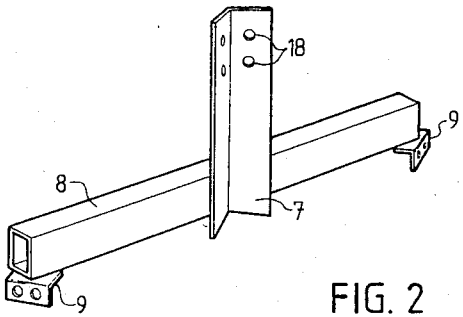
FIG. 2 shows a support bracket.

FIG. 2 shows the rear support assembly for the member 2. Cross brace 8 comprises a box channel member having angle section mounting brackets 9 at each end thereof. Upright angle bracket 7 is welded to cross brace 8 and includes bolt holes 18 to which adjoining ends of triangular frames 2 are bolted. Each of the bolt holes 13, 15,18 are drilled at say 12 mm to receive 10 mm bolts. In this manner appropriate adjustment may be made to the vertical angle of jack rafters 3 and the horizontal angle of triangular members 2 to ensure accurate vertical and horizontal alignment of brackets 17 and extensions 16 with adjacent rafters to facilitate attachment of the fascia.

It will be clear to a skilled artisan that although triangular frames 2 are each planar, when attached to the upright angle bracket 7, the plane of each frame 2 assumes the plane of adjacent faces of a hip roof.

Figure 3:
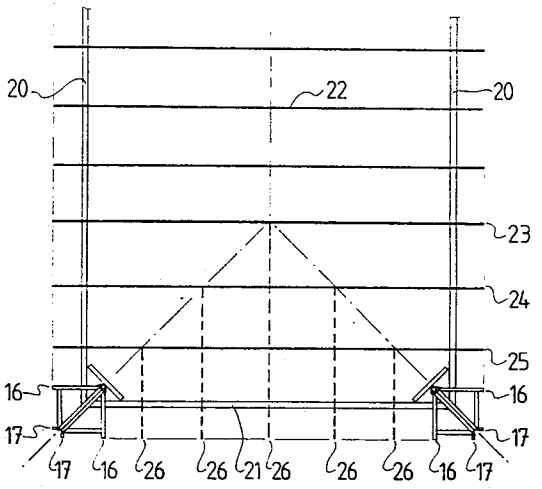
FIG. 3 shows schematically portion of a house frame having a hip roof.

FIG. 3 shows portion of a building structure in which members 1 are cantilevered from the corners of the structure by the mounting means described above. The structure comprises side wall frames 20 and an end wall 21. Spanning the opposing side walls 20 are conventional gable trusses 22 and a series of truncated trusses 23,24,25. Jack rafters 26 of appropriate lengths span the truncated trusses to form the face of the hipped end of the roof structure. It will be noted that the ends of the rafters of the gable trusses 22 and the ends of jack rafters 26 are aligned with brackets 17 and extended portions 16 to receive a fascia in a straight line.

In FIG. 4 a pair of conventional steel channel roof battens 27,28 are affixed to the upper edges of the truncated trusses 24,25 and jack rafters 26 are fixed on either side of the hip line. The alignment of the hip battens 22,28 is shown in FIG. 4*a* representing a cross section through A—A in FIG. 4.

In FIG. 5 shows schematically a completed hip roof structure.

It will be clear to a skilled addressee that the present invention provides a very elegant solution to construction of hip roofs on steel frame structures without sacrificing the advantages of prefabricated steel frame constructions.

FIG. 6 shows an alternative embodiment of the invention for providing a hipped verandah corner.

Spaced from wall frames 30,31 are verandah beams 30*a* and 31*a* respectively, each supported at convenient intervals and at the corners by upright verandah posts 32.

Extending between wall frames 30,31 adjacent the corner junction thereof are a pair of substantially triangular support frames 33,34 supported at their outer edges on verandah beams 30*a* and 31*a* respectively. Like the support bracket assembly of FIG. 1 the verandah corner support assembly comprises substantially identical triangular support frames 33,34 each having a rafter elements 35, a hip rafter member 36 and connecting intermediate members 35'. An additional connecting intermediate member 35" is provided adjacent the ends of rafter elements 35 and hip rafters 36. Again, like the support bracket assembly of FIG. 1, rafter elements 35 hip rafter 36 and intermediate connecting members 35' and 35" are comprised of 1.6 mm galvanized steel C-section channel welded at their junctions to provide rigid generally triangular support frames 33,34.

Each of the support frames 34,35 are supported along the verandah beams by the ends of rafter elements 35 and an end of hip rafter member 36. Rafter elements 35 are secured by bolts, screws or the like to the verandah beam and the outer end 37 of hip rafter 36 is formed at an included angle of 135 degrees to rest on the verandah beam and is secured to an angle bracket 38 in turn secured to the junction of verandah beams 30*a*,31*a*.

The inner end of each support frame is secured to a respective wall frame as shown in FIG. 7.

In FIG. 7 the respective ends of outer rafter members 35 have affixed thereto by suitable bolts "U" shaped brackets 35*a* which in turn are affixed to the top wall plates by screws, bolts or the like.

The inner ends of hip rafters 36 also rest on the top wall plates at the corner junction thereof and are affixed thereto by means of bolts, screws or the like passing through angle brackets 40 attached to the ends of the hip rafter members 36.

As illustrated in FIG. 7, the corner assembly comprising support frames adopts a bi-planar configuration due to the elevation of the inner diagonal corner over the outer diagonal corner corresponding respectively to the corner wall junction and the corner verandah beam junction. The support frames 33,34 are not strictly diagonal as portion of each inner and outer diagonal corner are removed to facilitate ease of access for mounting.

For internal verandah corners having a dished or concave bi-planar configuration, the assembly of FIG. 6 may be employed.

FIG. 8 is illustrated to show a variety of hips in a roof structure both in the main roof and the verandah.

In the main roof, structures of the type illustrated in FIG. 1 is employed at corner 41 and a verandah hip support of the type shown in FIGS. 6, 7, is used at corner 43.

At internal verandah corner 45, an inverted form of the structure of FIG. 6 is employed to form triangular support faces which are concavely dished as distinct from the convexly adjoining faces of the structures described above with respect to FIG. 6.

It will be clear to a skilled addressee that many modifications and variations may be made to the various aspects of the invention without departing from the spirit or scope thereof.

I claim:

1. A support assembly for a corner of a roofing structure, said support assembly comprising:

a rectangular frame having a pair of substantially triangular planar sub frames, each said sub frame being in the form of a right isosceles triangle, the hypotenuse side of each triangular sub frame abutting to form a diagonal intersection across said rectangular frame, said hypotenuse of each triangular sub frame combining in use to form a hip rafter and an adjacent side of each triangular sub frame forming a rafter element disposed at 90 degrees relative to each other; and, mounting means associated with one end of said hip rafter element to support said one end above an opposed end of said hip rafter whereby said planar triangular sub frames are tilted relative to each other along said diagonal intersection to co-operate with adjacent planes of a roof structure, said triangular sub frames each including a connecting member between and adjacent divergent ends of said hypotenuse side and said adjacent side.

2. A support assembly as claimed in claim 1 wherein said mounting means comprises an upright post attached to a support bracket mountable across the upper portion of the junction of corner walls of a building structure.

3. A support assembly as claimed in claim 2 wherein in use said divergent ends of said hypotenuse sides and said adjacent sides of said triangular sub frames are cantilevered over adjacent walls of an external corner of a building structure to form a corner of an eave structure formed by overhanging rafter members on adjacent roof planes.

4. A support structure as claimed in claim 3 wherein said rectangular frames forms an external corner of a hipped roof structure, said triangular sub frames being coplanar with adjacent planes of said roof structure.

5. A support structure as claimed in claim 1 wherein said mounting means comprises a bracket for attachment to an upper portion of an external corner of a building structure and an opposed end of said hip rafter and sides of said triangular sub frames opposite to said mounting means are adapted for support on a beam and post structure to form a corner support for a verandah roof structure.

6. A support assembly as claimed in claim 5 wherein said planar triangular sub frames are tilted downwardly at their outer edges to form a convex verandah corner frame assembly for an external corner of a building structure.

7. A support assembly as claimed in claim 5 wherein said planar triangular sub frames are tilted upwardly at their outer edges to form a concave verandah corner frame assembly for an internal corner of a building structure.

8. A method of constructing a hipped roof in a steel framed construction wherein a plurality of spaced progressively truncated roof truss members are located towards one end of a building structure to define a substantially triangulr hip roof plane, a support assembly as defined in any one of claims 1–4 is cantilevered over each corner of external walls of said building structure adjacent said hip roof plane and spaced substantially parallel hip rafter members are located on each side of a hip line formed at the junction of said hip roof plane and adjacent roof planes, said hip rafter members extending from adjacent a peak of said roof to adjacent a lower outer perimeter of said roof, said hip rafter members being secured to rafters of said roof and to respective rafter elements of said support assembly.

* * * * *

UNITED STATES PATENT AND TRADEMARK OFFICE

CERTIFICATE OF CORRECTION

PATENT NO. : 4,686,802

DATED : August 18, 1987

INVENTOR(S) : Bryan Edward O'Driscoll

It is certified that error appears in the above—identified patent and that said Letters Patent is hereby corrected as shown below:

ON THE TITLE PAGE, ITEM [73], should read "Nu-Steel Engineering (Brisbane) Pty.Ltd."

Signed and Sealed this

Sixth Day of December, 1988

*Attest:*

DONALD J. QUIGG

*Attesting Officer*

*Commissioner of Patents and Trademarks*